US007068179B2

(12) United States Patent
Snell et al.

(10) Patent No.: US 7,068,179 B2
(45) Date of Patent: Jun. 27, 2006

(54) HANDS-FREE DOOR OPENER AND METHOD

(75) Inventors: Nathan Snell, Mooresville, NC (US); Rafael Rodriguez, Ormond Beach, FL (US); Todd Krawczyk, Ormond Beach, FL (US); L. Gale Lemerand, Ormond Beach, FL (US)

(73) Assignee: Sanidoor, LLC, Daytona Beach, FL (US)

( * ) Notice: Subject to any disclaimer, the term of this patent is extended or adjusted under 35 U.S.C. 154(b) by 0 days.

(21) Appl. No.: 11/225,392

(22) Filed: Sep. 13, 2005

(65) Prior Publication Data

US 2006/0087429 A1 Apr. 27, 2006

Related U.S. Application Data

(63) Continuation of application No. 10/667,817, filed on Sep. 22, 2003, now Pat. No. 6,967,587.

(51) Int. Cl.
*G08B 21/00* (2006.01)

(52) U.S. Cl. ..... 340/686.6; 340/815.4; 340/944; 40/459

(58) Field of Classification Search ..... 340/686.6, 340/815.4, 545.1, 944, 524, 528, 545.3, 925; 40/459, 460; 49/13, 31, 139, 140
See application file for complete search history.

(56) References Cited

U.S. PATENT DOCUMENTS

| | | | |
|---|---|---|---|
| 3,560,950 | A | 2/1971 | Peters |
| 3,852,592 | A | 12/1974 | Scoville et al. |
| 4,023,151 | A | 5/1977 | Markham |
| 4,560,912 | A | 12/1985 | Jonsson |
| 4,577,437 | A | 3/1986 | Gionet et al. |
| 4,642,612 | A | 2/1987 | Crump |
| 4,660,324 | A | 4/1987 | Nyenbrink |
| 4,698,937 | A | 10/1987 | Kornbrekke et al. |
| 4,823,010 | A | 4/1989 | Kornbrekke et al. |
| 4,851,746 | A | 7/1989 | Milke |
| 4,896,144 | A | 1/1990 | Bogstad |
| 4,951,045 | A | 8/1990 | Knapp et al. |
| 4,967,083 | A | 10/1990 | Kornbrekke et al. |
| 4,972,629 | A | 11/1990 | Merendino et al. |
| 5,021,644 | A | 6/1991 | Beran et al. |
| 5,031,258 | A | 7/1991 | Shaw |
| 5,040,331 | A | 8/1991 | Merendino et al. |
| 5,060,323 | A | 10/1991 | Shaw |
| 5,086,526 | A | 2/1992 | Van Marcke |
| 5,095,654 | A | 3/1992 | Eccleston |
| 5,187,816 | A | 2/1993 | Chiou |
| 5,217,035 | A | 6/1993 | Van Marcke |
| 5,482,250 | A | 1/1996 | Kodaira |
| 5,657,004 | A | 8/1997 | Whittaker et al. |
| 5,670,945 | A | 9/1997 | Applonie |

(Continued)

*Primary Examiner*—Daniel Wu
*Assistant Examiner*—Jennifer Mehmood
(74) *Attorney, Agent, or Firm*—Allen, Dyer, Doppelt, Mibrath & Gilchrist, P.A.

(57) ABSTRACT

An apparatus for automatically opening a swinging restroom door is provided. The apparatus comprises an actuator, a control unit, and a power assisted drive mechanism that can be connected to an existing door closing mechanism. The actuator comprises a proximity sensor and further comprises a series of iconic symbols corresponding to predetermined proximity zones. The control unit is in electronic communication with the actuator with which signals are exchanged. The power assisted drive mechanism is in electronic communication with the control unit and can be connected to an existing door closing mechanism wherein the actions of the door closing mechanism are reversed and the door is opened.

5 Claims, 4 Drawing Sheets

U.S. PATENT DOCUMENTS 5,673,016 A 9/1997 Lutes
5,739,523 A 4/1998 Tsutsumi et al.
5,770,935 A 6/1998 Smith et al.
5,813,364 A 9/1998 Harrison
5,855,027 A 1/1999 Macedo
5,878,530 A 3/1999 Eccleston et al.
5,963,000 A 10/1999 Tsutsumi et al.
6,038,708 A 3/2000 Schreck
RE36,930 E 10/2000 Houten et al.
6,212,694 B1 * 4/2001 Porzio ..... 4/246.1
6,292,100 B1 9/2001 Dowling
6,461,013 B1 10/2002 Simon
6,588,153 B1 7/2003 Kowalczyk
6,678,999 B1 1/2004 Zengguang et al.
6,741,183 B1 5/2004 Burnett
6,744,369 B1 * 6/2004 Sata ..... 340/573.1
6,842,120 B1 * 1/2005 Colberg et al. ..... 340/691.1
6,940,406 B1 * 9/2005 Sata ..... 340/552
2002/0029412 A1 3/2002 Veal
2003/0167693 A1 9/2003 Mainini
2003/0182759 A1 10/2003 Breed et al.
2004/0041057 A1 3/2004 Byrd et al.
2005/0073425 A1 4/2005 Snell et al.

* cited by examiner

HANDS-FREE DOOR OPENER AND METHOD

CROSS-REFERENCE TO RELATED APPLICATIONS

This application is a continuation of U.S. application Ser. No. 10/667,817, filed Sep. 22, 2003 and issuing Nov. 22, 2005 as U.S. Pat. No. 6,967,587, the disclosure of which is hereby incorporated by reference herein in its entirety and all commonly owned.

FIELD OF THE INVENTION

The subject invention pertains to an apparatus for automatically opening a door and for more specifically for the hands-free opening of a restroom door.

BACKGROUND OF THE INVENTION

Bathroom door handles can be a hot bed for germs due to the poor hygiene practices of others. In an effort to avoid contact with the door handle, restroom patrons will often utilize any means available to open a restroom door and exist common necessary to avoid contact with the door handle. Quite often people use their feet to pry the door open, a paper towel to insulate their hands from the door handle, grasp the door in a location other than the handle, or even wait for another patron to enter, in an effort to avoid contact with the door altogether.

Automatic door openers are well-known in the art. They are generally operated by motion detectors and have bidirectional motors that both open and close the doors as a patron approaches the door. Essentially, the patron enters a zone in which a proximity detector detects the presence of the patron and automatically opens the door. There are certain drawbacks of these automatic door openers especially in the close quarters of a public restroom. For example, due to the small size of many public restrooms, proximity detectors can activate from almost any movement in the restroom. This results in the constant opening and closing of the restroom door due to the movement of the patron inside the restroom. In addition, patrons entering the restroom from the outside will often trigger the door to swing inward where another patron may be standing.

Attempts to remedy these drawbacks have been made by way of motors or opening mechanisms which stop progress when obstructed. While these improvements resolve a portion of the problems in that the patron in the path of the door is not injured, it is still inconvenient for all involved. Keeping convenience in mind, it is desirable to have a restroom door that can be opened both manually or automatically upon the affirmative action of a patron on the inside of the restroom. This allows the patron on the inside of the restroom to have a choice of automatically or manually opening the restroom door, as well as making the patron aware of the doors automatic opening so that any impedance thereof may be avoided.

SUMMARY OF THE INVENTION

Accordingly, it is an object to the present invention to provide an automatic restroom door opener initiated upon the affirmative action or command of a restroom patron. The automatic door opener comprises an actuator; a control unit and a power assisted drive mechanism. The drive mechanism comprises a limit unit which is in communication with a conventional door closer which allows the door to be opened manually from the inside or outside or automatically from the inside upon the affirmative action of a restroom patron. The affirmative action of the restroom patron required to open the automatic door, for example, can comprise a hand waving or oral command wherein the patron is provided instruction through iconic symbols triggered by the proximity of the patron to the actuator.

The actuator can be mounted in any area near the restroom door. For example, between the sink and door at a height sufficient to accommodate nearly any restroom patron. The actuator comprises at least one proximity sensor for detecting the proximity of a patron within at least one specific proximity zone. Each proximity zone corresponds to a specific distance from the activator.

For example, the proximity detector detects the presence of a patron in a first zone. The actuator then provides an iconic instruction and/or an audible signal to instruct the patron to wave hi or her hand close to the actuator. When the patron's hand is waved in front of the actuator, it enters a second proximity zone. The proximity sensor, or a second proximity sensor, then detects the proximity of the patron's hand to the actuator, provides an audible signal of detection and begins the door-opening process. At any time the door may be opened manually from inside or out.

The actuator alerts to the patron in each of the various zones and provides a corresponding iconic symbol on the face of the interface will light thereby instructing the patron on the process for opening the door. For example, as patron approaches the restroom door to exit the restroom, the proximity detector detects the presence of the patron as the patron enters a first proximity zone. Detecting the presence of the patron I the actuator flashes a first signal which alerts the patron I to the presence of the actuator and provides a "wave hand" iconic symbol instructing the patron I to wave his or her hand in front of the actuator. As the patron approaches the actuator and waves his or her hand in front of it, the patron's hand enters a second proximity zone and the actuator can illuminate a second iconic symbol or color which alerts the patron to the automatic opening of the door.

For example, the first and second proximity zones can be variably set to meet the needs of the specific restroom installation. The affirmative action for example can be a movement such as a hand wave or oral command in front of the actuator which then initiates the opening of the door. Upon completion of the affirmative action of the patron, a second audible signal can be provided alerting the patron to the opening of the door. This informs the patron that the inward swinging door will be opening immediately.

When initiated, the control unit sends a signal to the power-assisted drive mechanism attached to a conventional door closer. The conventional door closer can be a preexisting door closer or a door closing apparatus integrated into the system. Conventional door closers generally comprise an external gear on the top and bottom of the closer that rotates with the opening and closing of the door to which it is attached. When the external gear of the door closer is rotated in the appropriate direction, the door closer can be reversed and can operate to open the door.

The power-assisted drive mechanism comprises a motor, a gear box and a limit unit. The motor may be an AC or a DC motor, unidirectional or bi-directional. The gear box may comprise a variety of gears to translate the torque of the motor to the limiting unit which is attached to an external gear on the door closer. For example, the gear box may comprise a series of reduction gears in further communication with the limit unit. The limit unit provides for the positive opening of the door by the power-assisted drive mechanism. While there is a variety of methods in which to accomplish this task, the preferred method disclosed herein allows for power-assisted door opening as well as unobstructed manual door opening.

As the apparatus opens a swinging door, the control unit senses the maximum angle θ and adjusts the motor function accordingly. For example, when the door opens to the maximum angle θ, the control unit can eliminate all power to the motor thereby allowing the limit unit to reset the motor as the door comes to a closed position or in the alternative the control unit can reset the motor under power. In addition to detecting the maximum angle of the door θ, the control unit can also detect any fluctuation in current (i.e., voltage) caused by an impedance in the opening door and thereby initiate a failsafe program that operates to stop the opening of the door. Accordingly, should somebody step in the way of the door as it is opening as the door comes in contact with an obstruction such as a person, the control unit will detect an increase in motor power and initiate the failsafe program.

When the opening process is completed, the power to the motor can be eliminated or reversed by the control unit and the normal function of the door closer can take over and close the door in its usual fashion. Such a feature is highly desirable for a number of reasons. First, such a system allows for the bathroom door to open both automatically and manually. Second, the apparatus is easily adaptable to existing conventional door closers. Third, by utilizing an existing door closer time and money are saved by way of installation costs and materials. Further objects and advantages of the present invention will become apparent by reference to the following detailed description of the preferred embodiment and appended drawings wherein like reference numbers refer to the same feature, component, or element.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

The present invention will now be described more fully hereinafter with reference to the accompanying drawings, in which preferred embodiments in the invention are shown. This invention may, however, be embodied in many different forms and should not be construed as limited to the embodiments set forth herein. Rather, these embodiments are provided so that this disclosure will be complete, and will fully convey and disclose the invention to those skilled on the art. Like numbers refer to like elements throughout, and the prime notation indicates similar elements in the alternate embodiments.

Figure 1:
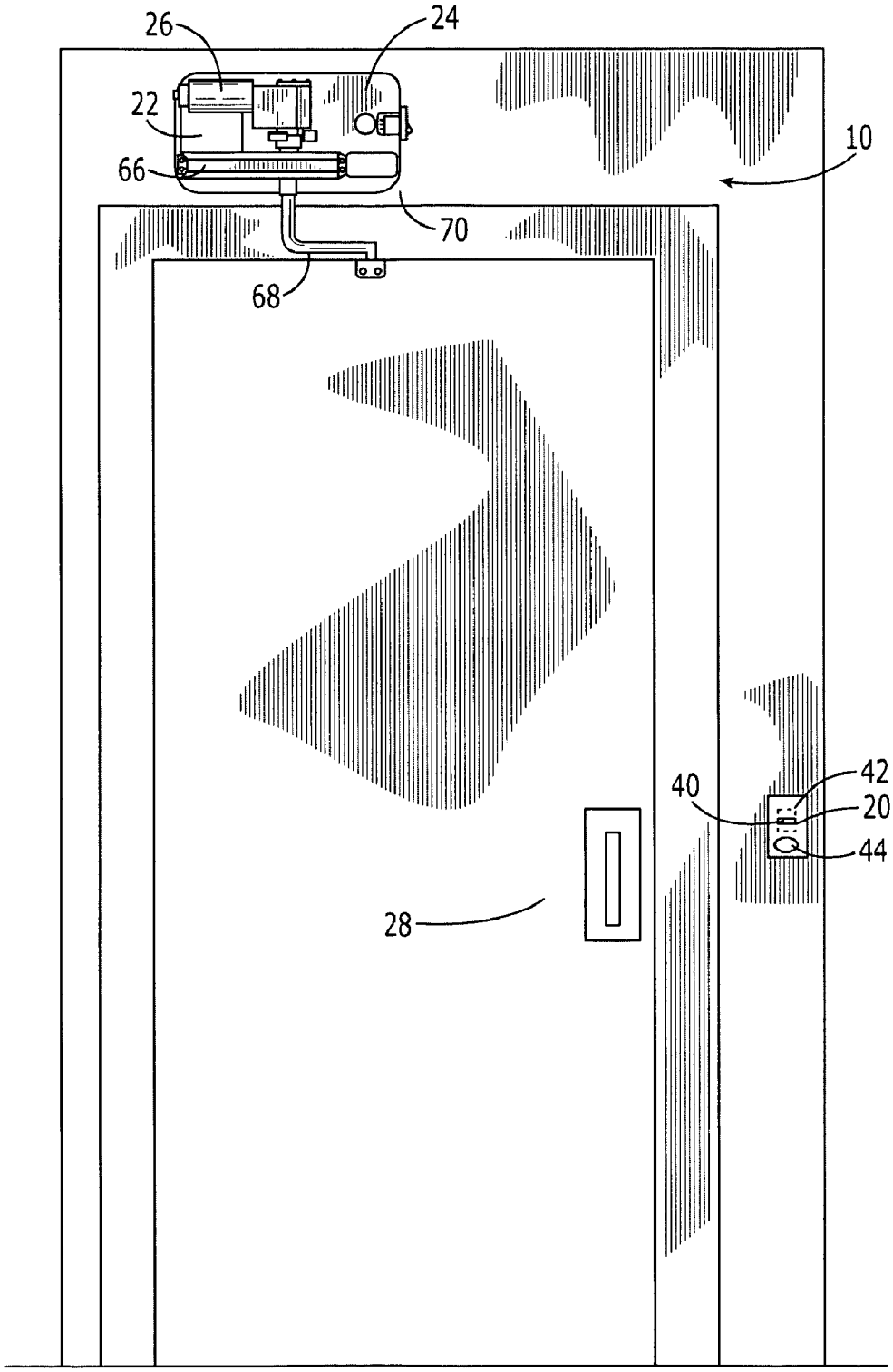
FIG. 1 is a perspective view of an inward swing door comprising the apparatus according to the present invention.
Figure 2:
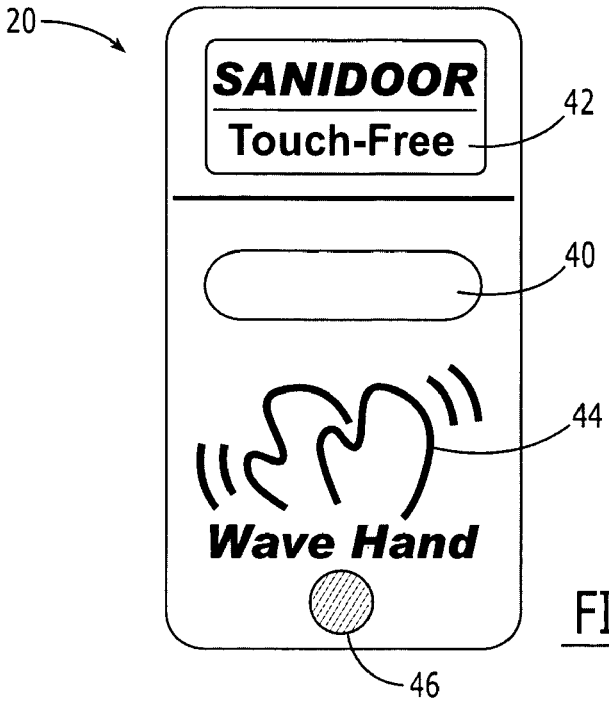
FIG. 2 is a plan view of the actuator device according to the present invention.
Figure 3:
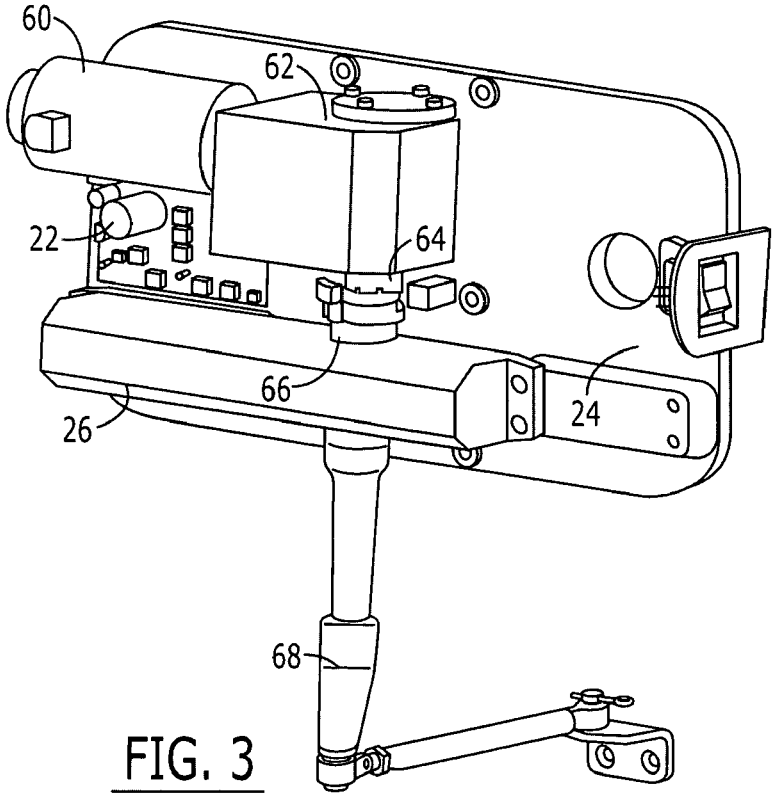
FIG. 3 is a perspective view of the power-assisted drive mechanism according to the present invention.
Figure 4:
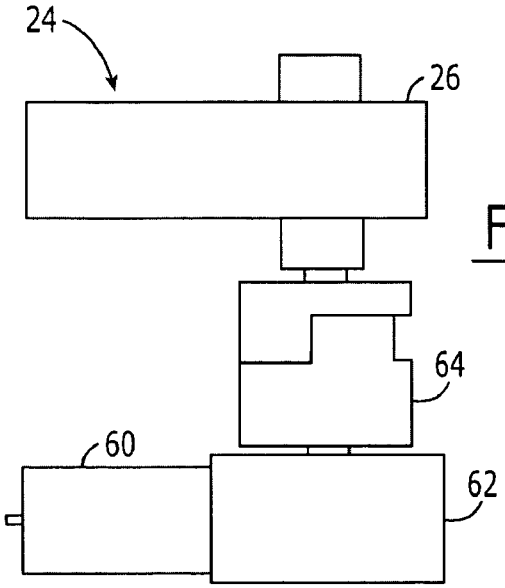
FIG. 4 is a plan view of the power-assisted drive mechanism according to the present invention.
Figure 5:
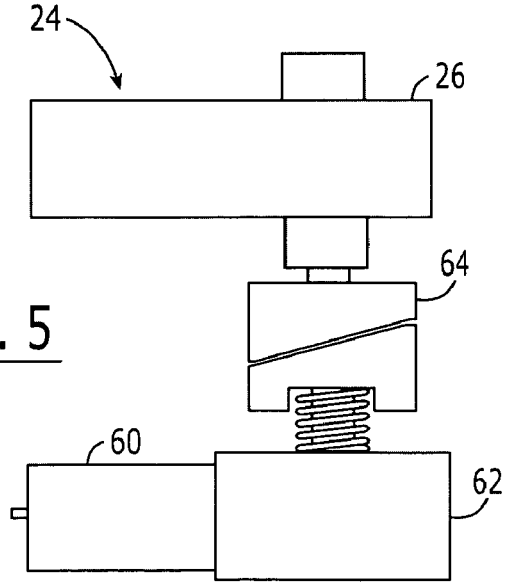
FIG. 5 is an alternative embodiment of the power-assisted drive mechanism according to the present invention.
Figure 6:
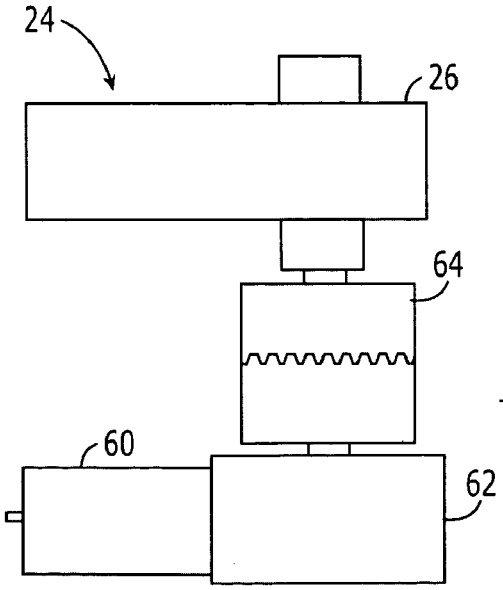
FIG. 6 is an alternative embodiment of the power-assisted drive mechanism according to the present invention.
Figure 7:
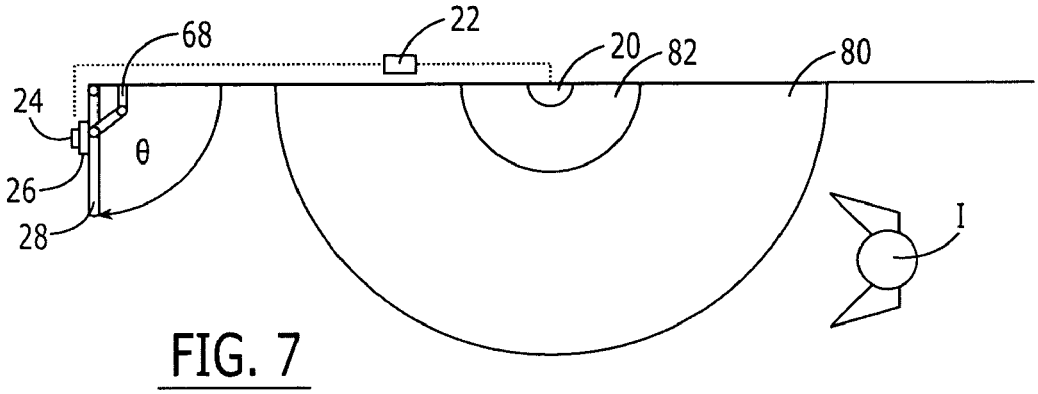
FIG. 7 is an illustration of the proximity zones according to the present invention.

Referring now to FIG. 1, an apparatus according to the present invention is illustrated and generally designated by the reference numeral 10.

The door opening apparatus 10 illustratively includes an actuator 20 a control unit 22 and a power-assisted drive mechanism 24. The power-assisted drive mechanism 24 illustratively is attached to a conventional door closer 26. The conventional door closer 26 may comprise a preexisting door closer or a door closer integrated into the apparatus 10. The apparatus provides for the egress from a restroom without requiring the manual contact with the door 28.

The actuator 20 comprises a proximity sensor 40, audible signals (not shown), a plurality of visual signals corresponding to the working status of the actuator. The control unit 22 is in electronic communication with the actuator 20 and the power-assisted drive mechanism 26 and functions to control both the actuator 20 and the power-assisted drive mechanism 24. The power-assisted drive mechanism comprises a motor 60 a gear box 62 and a limit unit 64. The door closer 26 may comprise an existing door closer or a door closer integrated with the apparatus 10.

It will be appreciated by those skilled in the art that the control unit 22 communicates to the actuator 20 and the power-assisted drive mechanism 24 through wires, fiber optics, electro magnetic signals, or a combination thereof. It will also be appreciated by those skilled in the art that the electro magnetic signals can include infra-red, RF, or any other electro magnetic signal known in the art.

The actuator 20 comprises at least one proximity sensor 40 and a plurality of visual signals. The plurality of visual signals may comprise an attention signal 42, an affirmative action signal 44 and a door opening signal 46. By way of example, as a patron I approaches an inward swinging restroom door 28 to exit the restroom, the patron I enters a first proximity zone 80 and the proximity sensor 40, in the actuator 20, detects the presence of the patron I. The proximity sensor 40 sends an electronic signal to the control unit 22 which sends an electronic signal from the control unit 22 to the actuator 20 that instructs the actuator 20 to provide an alert signal to the patron I.

For example, the alert signal to the patron I may comprise an attention signal 42, an audio signal (not shown) or a combination thereof. The attention signal 42 may comprise an illuminated iconic signal 42 which illuminates steadily or flashes to alert the patron I to the existence of the actuator 20. The attention signal 42 may further comprise an audible signal.

As the patron I moves closer to the restroom door 28 the proximity sensor 40 detects that the patron I is within a certain zone (for example a distance from the actuator up to 18 inches) and sends an electronic signal to the control unit 22 which in turns sends an electronic signal back to the actuator 20 to indicate a change in operation status, for example flashing the affirmative action icon 44 on the actuator 20. By way of example, the affirmative action visual signal 44 can instruct the patron I to wave their hand in front of the actuator 20 to initiate the opening of the door 28.

In an alternative embodiment, the actuator 20 constantly flashes to get the attention of the patron I. In such an embodiment, a single proximity zone 82 can be used. The actuator 20 does not require a first proximity zone 80 to detect the presence of the patron I. Instead the actuator 20 flashes continuously in an "always on" mode. When the patron I desires to exit the restroom, the iconic instruction 44 is already illuminated and the patron I need only to take the affirmative action necessary to initiate the hands free door opener 10.

As the patron I complies with the iconic instruction requiring the affirmative action, the proximity sensor 40 interprets the affirmative action and sends an electronic signal to the control unit 22 which, first, sends a signal back to the actuator to illuminate the door opening signal 46 and, second, initiates the door opening sequence.

To initiate the door opening sequence, the control unit 22 sends a signal to the power-assisted drive mechanism 24. The power-assisted drive mechanism 24 comprises a motor 60, gear box 62, and a limit unit 64. As will be appreciated by those skilled in the art, the motor 60 may be unidirectional or bi-directional AC or DC. The gear box 62 may comprise a variety of gears which operate to translate torque from the motor 60 to the limit unit 64. By way of example, the preferred gears of the present invention comprise a series of reduction gears (not shown) that allow the torque of the motor 60 to be translated substantially perpendicular to the plane of the motor 60, thus allowing a more compact power-assisted drive mechanism 24. The limit unit 64 receives torque from the gear box 62 and functions to open the restroom door 28 to a fixed angle θ. It will be appreciated by those skilled in the art that the limit unit 64 may operate to allow the door 28 to be opened mechanically or manually.

As the motor 60 receives the signal from the control unit 22 under normal conditions, it will provide torque to the gear box 62 which then provides torque to the limit unit 64 which is in further communication with a door closer 26.

The door closer 26 comprises an conventional door closing mechanism as is known in the art. For example, the door closer is mounted to the top of the door 28 and further comprises a double arm arrangement 68 that is attached to the header 70 above the door. Such a double arm arrangement 68 can operate to either push or pull the door 28 open depending on the configuration of the door closer26.

Conventional door closers generally comprise an external gear 66 on the top and/or bottom of the closer 26 that rotates with the opening and closing of the door 28 to which it is attached. The external gear 26 is generally connected to an internal piston (Not shown) located in the door closer 26 such that the opening of the double arm arrangement 68 causes the internal piston to compress an oil damping spring (not shown). Upon release of the door 28, the oil dampening spring causes the door 28 to close and the dampening system regulates the speed at which the door 28 closes. When the external gear 66 of the door closer 26 is rotated in the appropriate direction (i.e., reverse), the door closer 26 operates to open the door 28.

When the door 28 opens to the preset angle 74 , the control unit 22 detects the angle of the door 28 and sends a signal to the motor 60 to stop further progress. At this point, alternative events can occur. For example, all power to the motor 60 may be ceased and the motor may be returned to starting position as the door closer 26 functions in its normal capacity to close the door 28 thereby providing reverse torque on the limit unit 64 which is translated back through the gear box 62 to the motor 60. In another embodiment, the motor 60 may be bidirectional and as such, the control unit 22 can instruct the motor 60 to return to its starting position under its own power.

As the door opening sequence begins, should the door physically encounter any impedance (i.e., obstruction) the result will be a fluctuation in current (i.e., voltage) supplied to the motor 60. The control unit 22 may be programmed to detect any increase in motor voltage fluctuation and can then send a signal to the motor 60 to cease further operation. In the case of a uni-directional motor, the cease in function signal can operate simply to cut-off the electrical supply to the motor 60. In the case of a bidirectional motor, the cease and function instruction from the control unit 22 can operate to stop the progress of the motor 60 and return it to its starting position under its own power.

The control unit 22, can be programmed to operate, auxiliary electrical devices in a restroom such as lights, exhaust fans, aroma therapy dispensers, or other electronic apparatus that can be enjoyed by an patron I in a restroom. The control unit 22 receives electric power from an external source such as an electrical box or a junction box, a battery, or any other means from which electricity is produced. It will all be appreciated by those skilled in the art that the control unit may be programmed to operate a plurality of automatic door opening devices.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method for automatically opening a swinging door, the method comprising:

sensing a person within a proximity zone;

providing an iconic display to the person, the iconic display requesting an affirmative action from the person proximate a sensor;

actuating a power assisted drive mechanism operable with the swinging door for causing the door to open; and opening the door as a result of the affirmative action.

2. The method according to claim 1, further comprising providing an audible signal based on the person being in the proximity zone.

3. The method according to claim 1, wherein the affirmative action comprises waving a hand.

4. The method according to claim 1, wherein the proximity zone comprises multiple zones.

5. The method according to claim 4, wherein the multiple proximity zones correspond to preset distances.

* * * * *